United States Patent [19]

Wilson

[11] Patent Number: 4,913,427

[45] Date of Patent: Apr. 3, 1990

[54] BASEBALL PITCHING TARGET WITH A BALL RETURN

[76] Inventor: Jackie L. Wilson, 138-35 223rd St., Laurelton, N.Y. 11413

[21] Appl. No.: 242,648

[22] Filed: Sep. 12, 1988

[51] Int. Cl.[4] ..... A63B 71/02

[52] U.S. Cl. ..... 273/26 A

[58] Field of Search ..... 273/26 R, 26 A, 201, 273/29 R, 29 A, 184 R, 183 R, 410, 411, 11 R, 407

[56] References Cited

U.S. PATENT DOCUMENTS

| | | | |
|---|---|---|---|
| 1,089,262 | 3/1914 | Post et al. | 273/11 R |
| 1,170,715 | 2/1916 | Westgate | 273/26 A |
| 2,059,365 | 11/1936 | King | 273/26 A |
| 2,315,257 | 3/1943 | Harlow | 273/26 R |
| 3,229,975 | 1/1966 | Tompkins et al. | 273/26 A |
| 3,411,788 | 11/1968 | Blanding | 273/184 R |
| 4,199,141 | 4/1980 | Garcia | 273/26 A |
| 4,657,250 | 4/1987 | Newland et al. | 273/26 A |
| 4,770,527 | 9/1988 | Park | 273/184 R |

*Primary Examiner*—T. Brown

*Attorney, Agent, or Firm*—Michael I. Kroll

[57] ABSTRACT

A baseball pitching target with a ball return is provided and consists of a return chute angularly elevated to extend away from a box-like enclosure having an open front end with a target frame vertically suspended between the open front end of the enclosure and the chute. A person standing behind the chute can pitch a baseball through the target frame. The baseball is stopped by the enclosure and falls into the chute to be returned back to the person. One end of the return chute has a front wall removably attached to the return chute by a tongue and groove arrangement whereby the wall can be removed to allow a ball to roll out of the chute and into the field of practice.

3 Claims, 1 Drawing Sheet

Figure 5
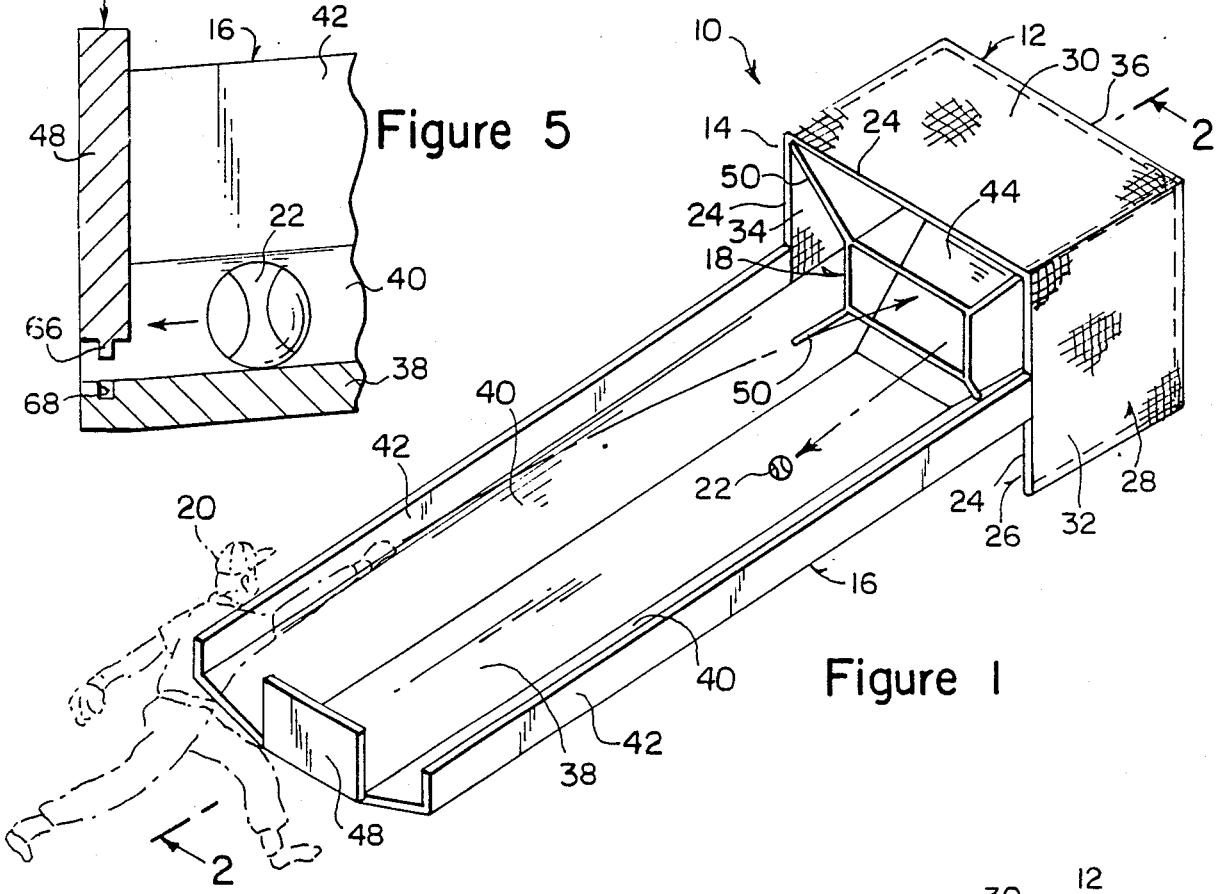
Figure 1
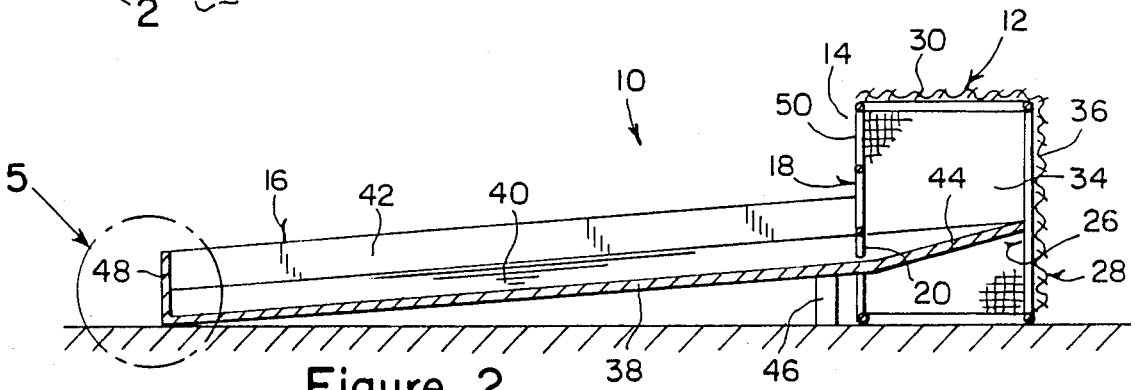
Figure 2
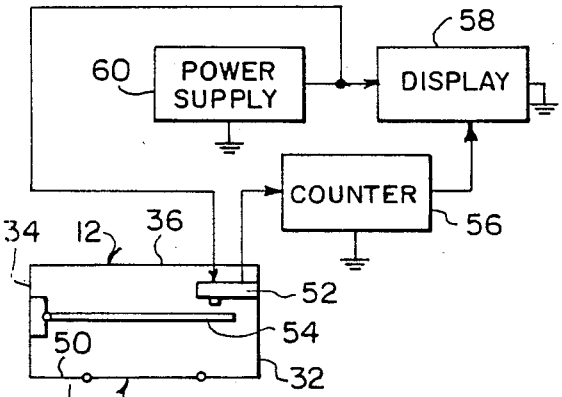
Figure 3
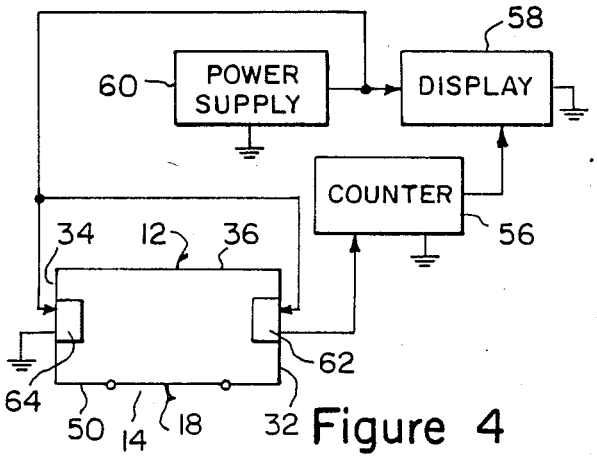
Figure 4

BASEBALL PITCHING TARGET WITH A BALL RETURN

BACKGROUND OF THE INVENTION

1. Field of the Invention

The instant invention realtes generally to self-practice devices for ball sports and more specifically it relates to a baseball pitching target with a ball return.

2. Description of the Prior Art

Numerous self-practice devices for ball sports have been provided in prior art that are adapted to include areas in which balls may be thrown into and structures which facilitate the balls are returned back. For example, U.S. Pat. Nos. 3,656,750; 4,275,883 and 4,703,931 all are illustrative of such prior art. While these units may be suitable for the particular purpose to which they address, they would not be as suitable for the purposes of the present invention as heretofore described.

SUMMARY OF THE INVENTION

A primary object of the present invention is to provide a baseball pitching target with a ball return that will overcome the shortcomings of the prior art devices.

Another object is to provide a baseball pitching target with a ball return which is a one-man pitching unit that will aid in improving user's pitching and fielding skills and abilities.

An additional object is to provide a baseball pitching target that is lightweight and durable so that the target can be portable to be used in a backyard, a driveway, a park or the like.

A further object is to provide a baseball pitching target with a ball return that is simple and easy to use.

A still further object is to provide a baseball pitching target with a ball return that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of the invention in use.

FIG. 2 is a cross sectional view taken along line 2—2 in FIG. 1.

FIG. 3 is a diagrammatic block diagram of a first form of the target area counter display circuit.

FIG. 4 is a diagrammatic block diagram of a second form of the target area counter display circuit.

FIG. 5 is an enlarged cross sectional view as indicated by numeral 5 in FIG. 2 showing the front wall being removable from the return chute.

DETAILED DESCRIPTION OF THE PREFERRED EMBODIMENTS

Turning now descriptively to the drawings, in which similar reference characters denote similar elements throughout the several views, FIGS. 1 and 2 illustrate a baseball pitching target with a ball return 10 consisting of a box-like enclosure 12 that has an open front end 14.

A return chute 16 is angularly elevated to extend away from the enclosure 12. A target frame 18 is vertically suspended between the open front end 14 of the enclosure 12 and the chute 16. A person 20 standing at the chute 16 can pitch a baseball 22 through the target frame 18. The baseball 22 will be stopped by the enclosure 12 and fall into the chute 16 to be returned back to the person 20.

The enclosure 12 includes a plurality of poles 24 affixed together to form a frame-like structure 26. A piece of tough, durable material 28 covers the frame-like structure 26 to form a top wall 30, a right side wall 32, a left side wall 34 and a rear wall 36 for stopping the baseball 22.

The return chute 16 includes an elongated flat floor 38 and a pair of side angular floors 40, each extending away at an opposite side of the flat floor 38. A pair of side walls 42 are also provided, in which each extends upwardly at an opposite side to one of the side angular floors 40. A rear angular wall 44 extends away from rear end of the flat floor 38 and the side angular floors 40, whereby the rear angular wall 44 extends under the top wall 30 to bear against the rear wall 36 of the enclosure 12. A pair of spaced apart vertical legs 46 at the rear end of the flat floor 38 are for angularly elevating the return chute 16. A front wall 48 extends upwardly at front end of the flat floor 38 to stop the baseball 22 when rolling down the return chute 16.

The target frame 18 further includes four support members 50, each extending from one corner thereof for vertically suspending the target frame 18 betwee the poles 24 of the enclosure 12 and the side angular floors 40 of the chute 16.

As shown in FIG. 3, a normally opened button switch 52 is mounted to side wall 32 of the enclosure 12 behind the target frame 18. A pivotable long arm 54 is mounted to other side wall 34 of the enclosure 12 behind the target frame 18 to make contact with the switch 52. A counter 56 is electrically connected to the button switch 52 while a display 58 is electrically connected to the counter 56. A power supply 60, such as a battery or house current, is connected to the display 58 and the switch 52. When the baseball 22 passes through the target frame 18 and strikes the long arm 54, the button switch 52 will close sending a signal through the counter 56 and putting a score on the display 58.

As shown in FIG. 4, a sensor 62 is mounted to side wall 32 of the enclosure 12 behind the target frame 18. An electronic eye 64 is mounted to other side wall 34 of the enclosure 12 behind the target frame 18 so as to be in alignment with the sensor 62. Counter 56 is electrically connected to the sensor 62 while display 58 is electrically connected to counter 56. Power supply 60 is electrically connected to the display 58, the sensor 62 and the electric eye 64. When the baseball 22 passes through the target frame 18 braking visual contact between the sensor 62 and the electric eye 64 a signal will be sent from the sensor 62 through the counter 56 and a score will be put on the display 58.

For best resutls the poles 24 could be made out of aluminum, the piece of material 28 made out of canvas, the chute 16 made out of aluminum, the target frame 18 made out of plastic and the support member 50 made out of nylon. Other types of materials can also be used in fabricating the invention.

The front wall 48 and front end of the flat floor 38 in the return chute 16, as shown in FIG. 5, further includes a tongue 66 and groove 68 arrangement therebetween so that the front wall 48 can be removed therefrom, allowing the baseball 22 to roll out of the return chute 16 for fielding practice.

LIST OF REFERENCE NUMBERS

10 baseball pitching target with ball return
12 box-like enclosure
14 open front end
16 return chute
18 target frame
20 person
22 baseball
24 pole
26 frame-like structure
28 piece of tough, durable material
30 top wall
32 right side wall
34 left side wall
36 rear wall
38 elongated flat floor
40 side angular floor
42 side wall
44 rear angular wall
46 vertical leg
48 front wall
50 support member
52 normally opened button switch
54 pivotable long arm
56 counter
58 display
60 power supply
62 sensor
64 electric eye
66 tongue
68 groove It will be understood that each of the elements described above, or two or more together, may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A baseball pitching target with a ball return, comprising:

(a) a boxshaped enclosure having an open front end and including a plurality of poles affixed together to form a frame structure, a piece of tough durable material covering said frame structure forming a top wall, a right side wall, a left side wall, and a rear wall for stopping the baseball;

(b) a return chute angularly elevated to extend away from said boxshaped enclosure and including an elongated flat floor having a rear end and a front end, a pair of side angular floors, each extending away at an opposite side of said elongated flat floor, a pair of side walls, each extending upwardly at an opposite side to one of said pair of side angular floors, a rear angular wall extending away from said rear end of said elongated flat floor and said pair of side angular floors, so that said rear angular wall extending under said top wall to bear against said rear wall of said boxshaped enclosure, a pair of spaced apart vertical legs disposed at said rear end of said elongated flat floor for angularly elevating said return chute, and a front wall extending upwardly at said front end of said elongated flat floor to stop the baseball when the baseball is rolling down the return chute, said front wall and said front end of said flat floor in said return chute further including a tongue and groove arrangement therebetween so that said front wall can be removed therefrom for allowing the baseball to roll out of said return chute for fielding practice;

(c) a target frame vertically suspended between said open front end of said boxshaped enclosure and said return chute, so that a person standing at said return chute can pitch a baseball through said target frame and the baseball being stopped by said boxshaped enclosure and falling into said return chute to be returned back to the person, said target frame further including four support members, each of which extending from one corner thereof for vertically suspending said target frame between said plurality of poles of said boxshaped enclosure and said pair of side angular floors of said return chute.

2. A baseball pitching target as recited in claim 1, further comprising:

(a) a noramally opened button switch mounted to one of said side walls of said enclosure behind said target frame;

(b) a pivotable long arm mounted to other of said side walls of said enclosure behind said target frame to make contact with said switch;

(c) a counter electrically connected to said button switch;

(d) a display electrically connected to said counter; and (e) a power supply electrically connected to said display and said switch so that when the baseball passes through said target frame and strikes said long arm, said button switch will close sending a signal through said counter and putting a score on said display.

3. A baseball pitching target as recited in claim 2, further comprising:

(a) a sensor mounted to one of said side walls of said enclosure behind said target frame;

(b) an electric eye mounted to other of said side walls of said enclosure behind said target frame so as to be in alignment with said sensor;

(c) a counter electrically connected to said sensor;

(d) a display electrically connected to said counter; and (e) a power supply electrically connected to said display, said sensor and said electric eye so that when the baseball passes through said target frame braking visual contact between said sensor and said electric eye a signal will be sent from said sensor through said counter and a score will be put on said display.

* * * * *